US009146535B2

(12) United States Patent
Capt

(10) Patent No.: US 9,146,535 B2
(45) Date of Patent: Sep. 29, 2015

(54) TIMEPIECE BARREL WITH REDUCED CORE DIAMETER

(75) Inventor: Edmond Capt, Le Brassus (CH)

(73) Assignee: BLANCPAIN SA, Le Brassus (CH)

( * ) Notice: Subject to any disclaimer, the term of this patent is extended or adjusted under 35 U.S.C. 154(b) by 0 days.

(21) Appl. No.: 14/239,730

(22) PCT Filed: Sep. 13, 2012

(86) PCT No.: PCT/EP2012/067908
§ 371 (c)(1),
(2), (4) Date: Feb. 28, 2014

(87) PCT Pub. No.: WO2013/037867
PCT Pub. Date: Mar. 21, 2013

(65) Prior Publication Data

US 2014/0211595 A1 Jul. 31, 2014

(30) Foreign Application Priority Data

Sep. 15, 2011 (EP) ..... 11181354

(51) Int. Cl.
*G04B 1/16* (2006.01)
*G04B 1/18* (2006.01)
*G04B 1/14* (2006.01)

(52) U.S. Cl.
CPC ..... *G04B 1/165* (2013.01); *G04B 1/145* (2013.01); *G04B 1/16* (2013.01); *G04B 1/18* (2013.01)

(58) Field of Classification Search
CPC ..... G04B 1/10; G04B 1/14; G04B 1/16; G04B 1/18; G04B 33/14; G04B 35/00; G04B 1/165; G04B 1/145
See application file for complete search history.

(56) References Cited

U.S. PATENT DOCUMENTS

| | | | | |
|---|---|---|---|---|
| 182,629 | A | 9/1876 | Barclay | |
| 820,252 | A | 5/1906 | Porter | |
| 886,196 | A | 4/1908 | Faller | |
| 1,033,020 | A * | 7/1912 | Kern | 368/142 |
| 3,121,990 | A * | 2/1964 | Laviolette | 368/127 |
| 3,974,639 | A | 8/1976 | Gilomen et al. | |
| 4,077,201 | A * | 3/1978 | Perrot | 368/324 |
| 2005/0249045 | A1 * | 11/2005 | Schneider | 368/140 |
| 2010/0149928 | A1 * | 6/2010 | Reynard | 368/206 |
| 2013/0044574 | A1 * | 2/2013 | Kaelin et al. | 368/318 |
| 2013/0133788 | A1 * | 5/2013 | Aljerf et al. | 148/548 |
| 2013/0223194 | A1 * | 8/2013 | Cattin et al. | 368/143 |

FOREIGN PATENT DOCUMENTS

| | | | |
|---|---|---|---|
| CH | 295135 | A | 12/1953 |
| CH | 521 623 | A | 12/1971 |
| EP | 2 196 866 | A2 | 6/2010 |
| FR | 1 371 491 | A | 9/1964 |
| FR | 1 473 744 | A | 3/1967 |
| FR | 2 287 717 | A1 | 5/1976 |
| GB | 647819 | A | 12/1950 |
| JP | 11 183644 | A | 7/1999 |
| WO | 2012/010941 | A1 | 1/2012 |

OTHER PUBLICATIONS

International Search Report of PCT/EP2012/067908 dated Feb. 4, 2013.

* cited by examiner

*Primary Examiner* — Amy Cohen Johnson
*Assistant Examiner* — Matthew Powell
(74) *Attorney, Agent, or Firm* — Sughrue Mion, PLLC

(57) ABSTRACT

Timepiece barrel assembly, including a mainspring mounted between a drum and a receiving surface of a core coaxial to this drum about an axis. The core includes in series from a first end towards a second end: a means of fixing a ratchet, and/or a first pivot shoulder in a plate; a second pivot shoulder of this drum; a collar radially projecting relative to this shoulder and resting on an inner face of the drum towards the spring; set back radially relative to the collar, the receiving surface; set back radially relative to the receiving surface, a third pivot shoulder of a cover for closing the barrel; and a fourth pivot shoulder in a plate.

12 Claims, 5 Drawing Sheets

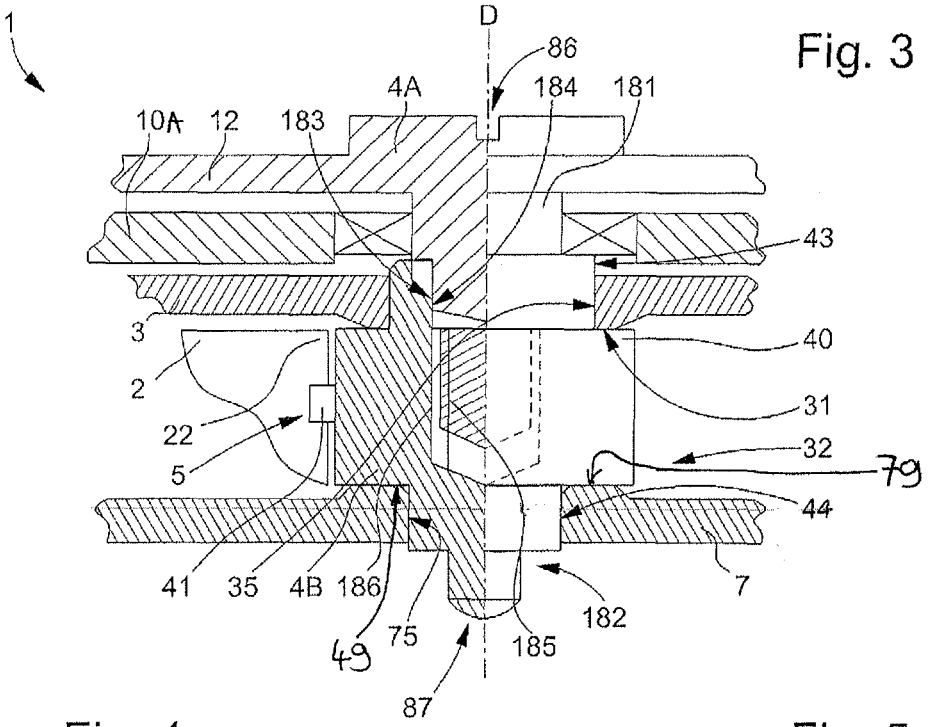
Fig. 3
Fig. 4
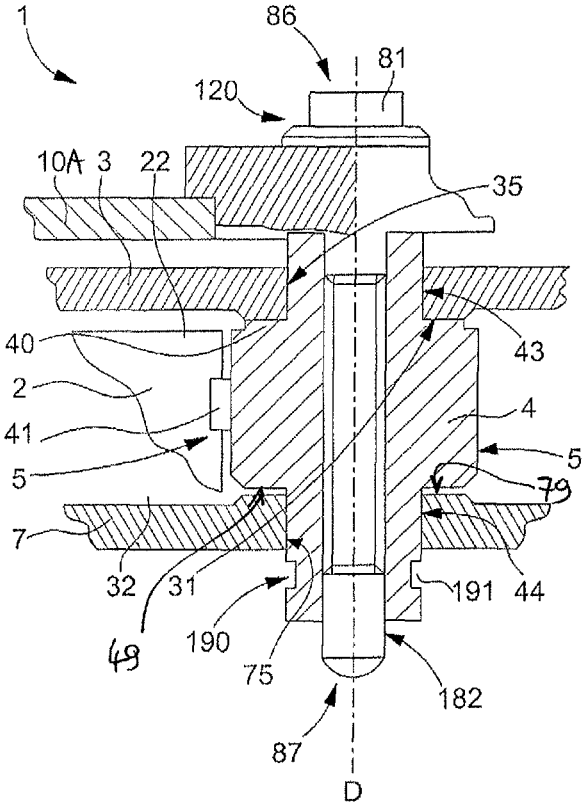
Fig. 5
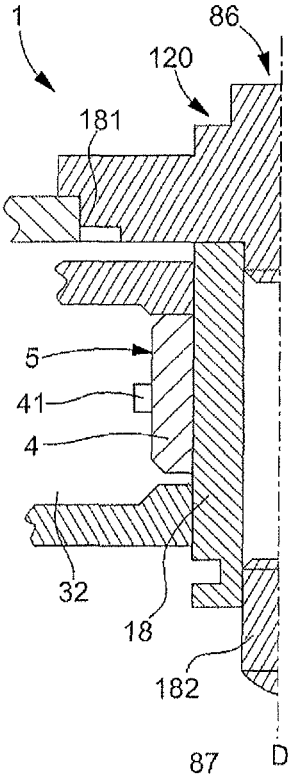

TIMEPIECE BARREL WITH REDUCED CORE DIAMETER

CROSS REFERENCE TO RELATED APPLICATIONS

This is a National Stage of International Application No. PCT/EP2012/067908 filed Sep. 13, 2012, claiming priority based on European Patent Application No. 11181354.9 filed Sep. 15, 2011, the contents of all of which are incorporated herein by reference in their entirety.

FIELD OF THE INVENTION

The invention concerns a barrel assembly for a mechanical watch having a reduced core diameter.

The invention also concerns a timepiece movement including at least one such barrel assembly.

The invention also concerns a timepiece including at least one movement of this type, and/or at least one barrel assembly of this type.

The invention concerns the field of horology, and more specifically the field of energy storage barrels, for powering a movement, a striking work, or another timepiece function.

BACKGROUND OF THE INVENTION

In order to increase the power reserve, by increasing the number of turns of a mainspring, one solution consists in decreasing the diameter of the barrel arbour and of the associated core, so as to increase the space available for the spring inside the drum.

The ratio of the core radius to the spring thickness is usually comprised between 10 and 20 and the invention proposes to reduce this ratio to below 10, and preferably to within a range of between 5 and 10.

The sizing must not be too small; there is a risk of breakage if the core diameter is too small.

In the conventional barrel architecture, a ratchet is axially mounted on a barrel arbour or on a core, via a square, with the ratchet usually being secured by an axial screw. The dimension of this screw and that of the square thus define the minimum diameter of a pivot shoulder. A step portion joined to this pivot shoulder limits the endshake of the arbour or of the core relative to a bottom plate or to a bridge carrying a jewel or similar element.

An even larger diameter than that of the step portion is required for a shoulder for guiding the pivoting of the drum on the arbour or on the core, combined with a step portion limiting the endshake of the drum. The dimension chain required to observe minimal sections of material results in substantial dimensions, which are difficult to reduce. In particular, it is not sufficient merely to reduce all of the dimensions, since the cross-sections of material are then insufficient to ensure fatigue resistance.

FR Patent No 2287717A1 in the name of SCHILD discloses a barrel with a ratchet wheel fixed to the arbour and adjacent to the bridge 10A in which the arbour pivots. The barrel includes a single-piece click, formed of a rigid part rotatably movable about the arbour between a locking position and a release position, and a resilient arm whose free end has a locking beak able to engage in the ratchet toothing. The click is housed inside a recess in bridge 10A between bridge 10A and the ratchet wheel. The free end of the arm has a bearing element located inside the contour of the ratchet, the flanks of this recess include two stop members one of which cooperates, in a locking position, with the bearing element and the other with the locking beak, to determine the locking position FR Patent Application No. 11371491 A in the name of PONS discloses a lubrication method and device. The ratchet fixed to the barrel arbour has access apertures on one portion of barrel bridge 10A or on one portion of the top barrel bearing. Bridge 10A may have similar apertures, as does the main plate for access to the cover bearing.

US Patent Application No. 886196A in the name of FALLER LEWIS ALBERT describes a barrel where the barrel drum and cover pivot in a limited manner via the walls of a cavity formed by a plate and a bridge 10A pressed against each other. The drum pivots about the barrel arbour via a ring which includes two flat portions which cooperate with an oblong hole in the drum. This ring carries the ratchet via a screw thread and the ratchet pivots in a limited manner via the walls of a cavity defined by the main plate and the drum. On the opposite side, the arbour carries a wheel between the cover and bridge 10A.

CH Patent Application No 295135A in the name of BRAC discloses a barrel wherein the core carries the ratchet, whose motion is limited by a thread on the plate. This core pivots on an arbour, one end of which cooperates with a bore in the plate, and the other end of which includes a screw thread. This screw thread cooperates with the inner thread of a centring case mounted in a bore in bridge 10A. The screw thread and the support plate hold a centring ring forming a stop member for the end of the core on the side of bridge 10A.

EP Patent Application No 2196866A2 in the name of HORLOGERS SARL concerns a bayonet device fixing the ratchet to an end square of the arbour. It combines a non-circular drive profile at the end of the arbour, which is separated by a groove from a stepped portion for the abutment of the ratchet. The ratchet includes a cutout part of complementary shape to the non-circular drive profile, onto which it is fitted and then placed in abutment on the collar. A securing washer includes a cutout part of complementary shape to the non-circular drive profile of the arbour, onto which it is fitted. This washer is then screwed onto the ratchet by at least one eccentric screw.

JP Patent Application No 11183644A in the name of SEIKO INSTR INC concerns a barrel which includes, for displaying the power reserve of the barrel, the use of the drum as a planetary wheel holder, which holds a planetary wheel pivotally mounted on the base thereof. The plate of this planetary wheel meshes with a wheel coaxial to the barrel arbour, whereas its pinion meshes with a solar wheel, also coaxial with the barrel arbour, axially retained by a stop. The solar wheel meshes with a wheel of a gear train pivoted on the main movement plate.

US Patent Application No 820252A in the name of PORTER WILSON discloses a barrel arbour with a hook on a median shoulder of large diameter, and a recess in front of the hook for the mainspring.

SUMMARY OF THE INVENTION

As a result of these physical limitations on the dimensioning of the various components, it is necessary to envisage different barrel architectures from the conventional architecture that has just been described.

A significant constraint is ensuring that the assembly can be dismantled, if necessary, to change the mainspring.

The invention proposes to set in place a solution allowing the core diameter to be significantly reduced compared to the prior art.

The invention therefore concerns a timepiece barrel assembly, including at least one barrel mainspring mounted between, at a first end, a barrel drum, and at a second end, a receiving surface comprised in a barrel core, coaxial to said drum about a pivot axis, characterized in that the maximum radius of said core relative to said pivot axis is less than ten times than maximum thickness of said spring, further characterized in that said core includes in series, from a first end towards a second end:

- a means of fixing a ratchet, and/or a first pivot shoulder in a plate or a bridge of a timepiece mechanism,
- then a second pivot shoulder relative to a first bore of said drum,
- then a collar radially projecting relative to said shoulder and cooperating in abutment with a first inner face of said drum on the side of said at least one spring,
- then, flush with or set back radially relative to said collar, said receiving surface for said at least one spring,
- then, set back radially relative to said receiving surface, a third pivot shoulder relative to a second bore in a cover arranged to form, with said drum, a chamber containing said at least one mainspring,
- then a fourth pivot shoulder in a plate or a bridge of said timepiece mechanism.

According to a feature of the invention, the external diameter of said core decreases in steps from said collar to said second end.

According to a feature of the invention, the external diameter of said core decreases in steps from said collar to said first end.

According to a feature of the invention, said shoulder forms the shoulder of largest diameter after said collar.

According to a feature of the invention, said barrel assembly includes a means of extraction arranged to allow the axial extraction of said core, along said pivot axis, by the exertion of a thrust or traction force on said core.

According to a feature of the invention, said extraction means is formed by at least one groove and/or a stepped portion comprised in said core in proximity to said second end and after said shoulder.

According to a feature of the invention, said spring is confined within a chamber delimited by said drum and a cover fixed to said drum, and said core includes a second lower, outer, shafted part over which a bore of said cover slides.

According to a feature of the invention, said core is made in at least two parts, a first part of smaller diameter than the smallest of the two diameters of said bore of said drum and of said bore of a cover; and the other second part including a bore driven onto said first part, and said second part either includes said mainspring receiving surface or forms the inner end of said mainspring.

According to a feature of the invention, said core is made in at least two parts, a first part called the inner part including said means of securing the ratchet or forming said ratchet, and including said first pivot shoulder, said first part including a centring shoulder and an external thread, respectively an internal thread, along said pivot axis, and the other second part including a centring bore fitted onto said centring shoulder, and including an internal thread, respectively an external thread complementary to said external thread, respectively internal thread, of said first part, said second part carrying said shoulder, said collar, said mainspring receiving surface or forming the inner end of said mainspring, and also carrying said shoulder, and said fourth pivot shoulder.

According to a feature of the invention, said core is made in at least two parts, a first part including a cylindrical or tubular barrel arbour and including at the two opposite axial ends thereof said first pivot shoulder and said fourth pivot shoulder which are either in a single-piece with said barrel arbour or secured thereto by screwing and/or hooping and/or welding, and the other second part which carries said shoulder and said collar, includes said mainspring receiving surface or forms the inner end of said mainspring, and also carries said shoulder, said second part including a bore driven onto said first part.

According to a feature of the invention, said first part is made in a single piece with a ratchet-holder or with said ratchet.

According to a feature of the invention, said second part includes a means of pivotally driving said first part and/or said ratchet arranged to cooperate with a complementary drive means of said first part or of said ratchet, and to ensure both a pivot contact and a contact in the axial direction of said pivot axis.

According to a feature of the invention, said second part is in turn formed of several coaxial parts, one of which is made in the form of a ring and carries a hook for hooking an eye of said at least one spring.

According to a feature of the invention, said receiving surface carries a hook for hooking an eye of said at least one spring, and said core includes, facing said hook, a recess for the passage of a mill or of straddle cutters for machining said hook or a series of milling tools for machining said hook.

According to a feature of the invention, said ratchet is in a single piece with said core.

According to a feature of the invention, said receiving surface is a surface of revolution relative to said pivot axis.

According to a feature of the invention, said spring is fixed by friction to said core.

According to a feature of the invention, said spring forms, with said core, a welded or soldered single-piece spring-core sub-assembly.

The invention further concerns a movement including at least one barrel assembly of this type for storing energy with one input formed either by a ratchet mounted for integral rotation with said core, or by a barrel arbour mounted integral with said core, or by a drum toothing mounted for integral rotation with said drum, and an output formed respectively either by a drum toothing mounted for integral rotation with said drum, or by a ratchet mounted for integral rotation with said core or with said barrel arbour.

The invention further concerns a timepiece including at least one timepiece movement of this type and/or at least one barrel assembly of this type for storing energy with one input formed either by a ratchet mounted for integral rotation with said core, or by a barrel arbour mounted integral with said core, or by a drum toothing mounted for integral rotation with said drum, and an output formed respectively either by a drum toothing mounted for integral rotation with said drum, or by a ratchet mounted for integral rotation with said core or with said barrel arbour.

BRIEF DESCRIPTION OF THE DRAWINGS

Other features and advantages of the invention will appear more clearly upon reading the following detailed description, with reference to the annexed drawings, in which:

FIG. 3 is a variant of the barrel according to the invention, wherein the collar also forms the mainspring receiving surface and is made in two parts, of which the axial part carries a ratchet.

FIG. 4 is a variant of the barrel of the invention, with a core made in three coaxial parts, including two along the pivot axis of the barrel.

FIG. 5 is a variant of the barrel of the invention, with a core made in four coaxial parts, including two along the pivot axis of the barrel, and a tubular part carrying an external part carrying a hook for hooking the mainspring.

FIG. 8 being a view along the pivot axis and FIGS. 7 and 8 being cross-sections along the pivot axis.

DETAILED DESCRIPTION OF PREFERRED EMBODIMENTS

Figure 1:
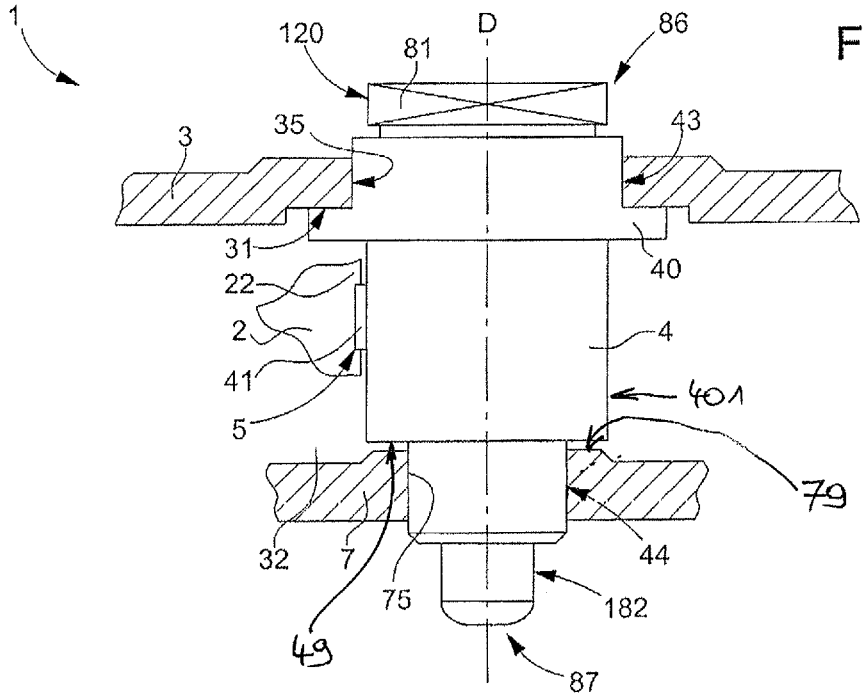
FIG. 1 shows a schematic cross-section of a timepiece barrel according to the invention in a plane passing through the pivot axis thereof, with a core including a collar cooperating with an inner surface of a barrel drum.

The invention concerns the field of horology, and more specifically the field of energy storage barrels, for powering a movement, a striking work, or another timepiece function.

More specifically, the invention concerns a barrel for a mechanical watch having a reduced core diameter.

The invention concerns a timepiece barrel assembly 1, including at least one barrel mainspring 2. This spring 2 is conventionally mounted between, at a first end 21, a barrel drum 3, and at a second end 22, a receiving surface 5 comprised in a barrel core 4 coaxial to drum 3 about a pivot axis D.

Spring 2 is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa. This spring 2 has a width to thickness ratio comprised between 3 and 23, and in particular between 9 and 21. Core 4 is made of steel or stainless steel. The maximum radius of core 4 relative to pivot axis D is less than ten times the maximum thickness of spring 2, and preferably less than eight times said thickness, as a result of the arrangements described below.

Core 4 includes in series from a first end 86 towards a second end-87:

- a means 120 of fixing a ratchet 12, and/or a first pivot shoulder 181 in a plate 10 or a bridge 10A of a timepiece mechanism,
- then a second pivot shoulder 43 relative to a first bore 35 of drum 3,
- then a radially projecting collar 40 relative to shoulder 43 and cooperating in abutment with a first inner face 31 of drum 3 on the side of at least one spring 2,
- then, flush with or set back radially relative to collar 40, receiving surface 5 for at least one spring 2,
- then, set back radially relative to receiving surface 5, a third pivot shoulder 44 relative to a second bore 75 in a cover 7 arranged to form, with drum 3, a chamber 32 containing at least one mainspring 2,
- then a fourth pivot shoulder 182 in a plate or a bridge 10A of the timepiece mechanism.

In the FIG. 1 embodiment, barrel arbour 4 is in a single-piece and includes a bearing collar 40 on first inner face 31 of drum 3, whose collar diameter is greater than the envelope diameter of the bearing surface of spring 2, which includes hook 41. This collar 40 does not form the bearing surface for spring 2.

Collar 40 limits the shake between arbour 4 and drum 3 in one direction, the shake is limited in the other direction by a shoulder 49 of the arbour with an inner boss 79 of cover 7.

Most of the volume of chamber 32 is reserved for spring 2, and the spring bearing surface can be of smaller diameter than in known barrels.

In the variant illustrated in FIG. 1, the external diameter of core 4 decreases in steps from collar 40 to the second end 87.

Figure 2:
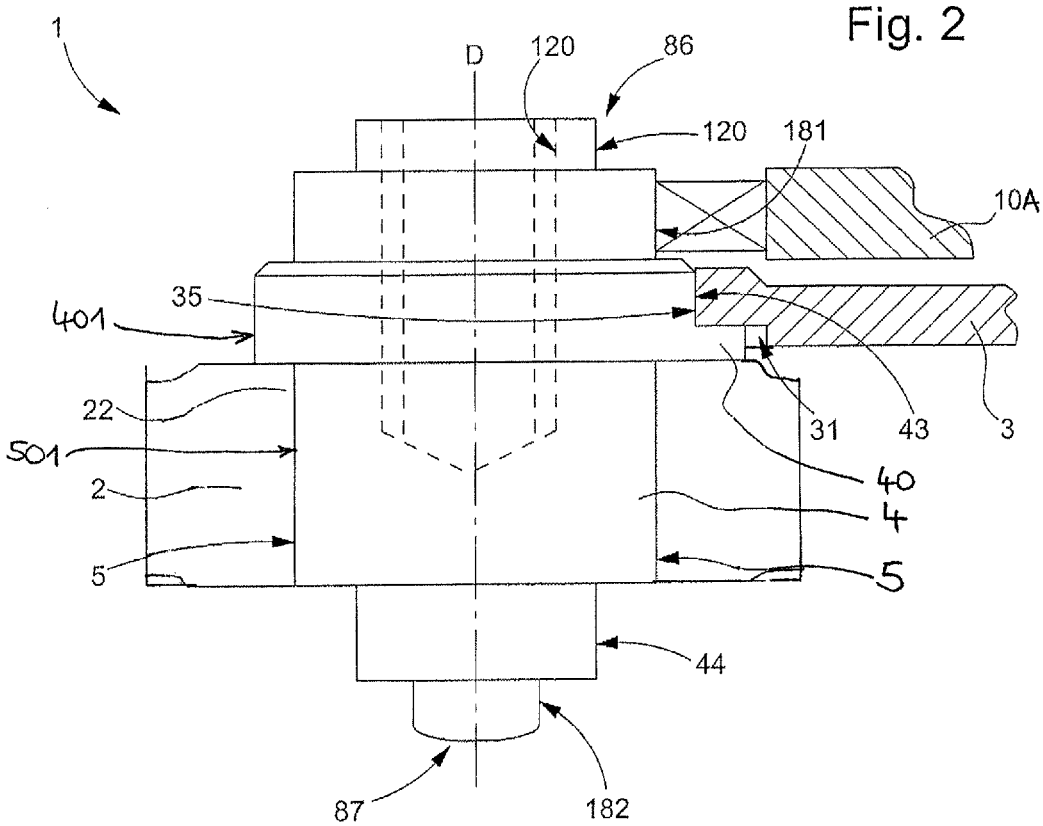
FIG. 2 is a variant of FIG. 1, with the core pivoting in a plate beyond the drum barrel.
Figure 12:
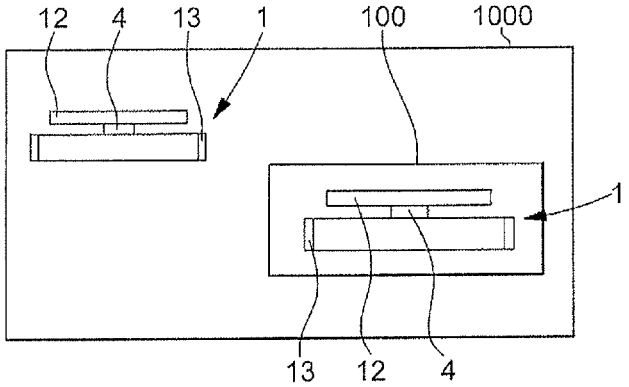
FIG. 12 shows block diagrams of a timepiece movement including a barrel assembly according to the invention and a timepiece including the movement and a barrel assembly according to the invention.

In the example embodiment shown in FIG. 2, the external diameter of core 4 decreases in steps from collar 40 to the first end 86. Collar 40 cooperates in abutment with a first inner face 31 in a stepped portion of drum 3.

The embodiment of FIG. 2 is a variant of FIG. 1, with an additional shoulder for guiding the arbour in the bridge, above the shoulder arranged on the drum.

The invention makes it possible to improve the power reserve of existing calibres, without any major modifications thereto. For example, a particular embodiment, for the application of the invention to the barrel of the "Frederic Piguet 1180 BLANCPAIN" calibre, achieved without modifying the barrel cover, corresponds to a diameter 401 with a value of 1.80 mm and a diameter 501 with a value of 1.20 mm.

As seen in FIG. 1, in a particular variant, shoulder 43 forms the shoulder of largest diameter after collar 40. Preferably, the diameter of shoulder 43 is greater than the largest diameter of the bearing surface 5 for spring 2.

Advantageously, barrel assembly includes a means of extraction 190 arranged to allow the axial extraction of core 4, along pivot axis D, by the exertion of a thrust or traction force on core 4.

In FIGS. 4 and 5, in a non-limiting embodiment, this extraction means 190 is formed by at least one groove 191 and/or a stepped portion comprised in core 4 in proximity to second end 87 and beyond shoulder 44. These two Figures illustrate a core in at least three parts: an upper core part outside the drum, with a stepped portion abutting on the side of the bridge opposite the barrel, and driven or screwed into a median part. The median part, between the drum and cover, carrying the spring, either directly (FIG. 4) or indirectly via an added ring (FIG. 5), is provided with an extraction means 190 in the form of a groove at the opposite end to the upper part. A lower part for guiding inside the plate is driven or screwed into the median part.

Figure 4A:
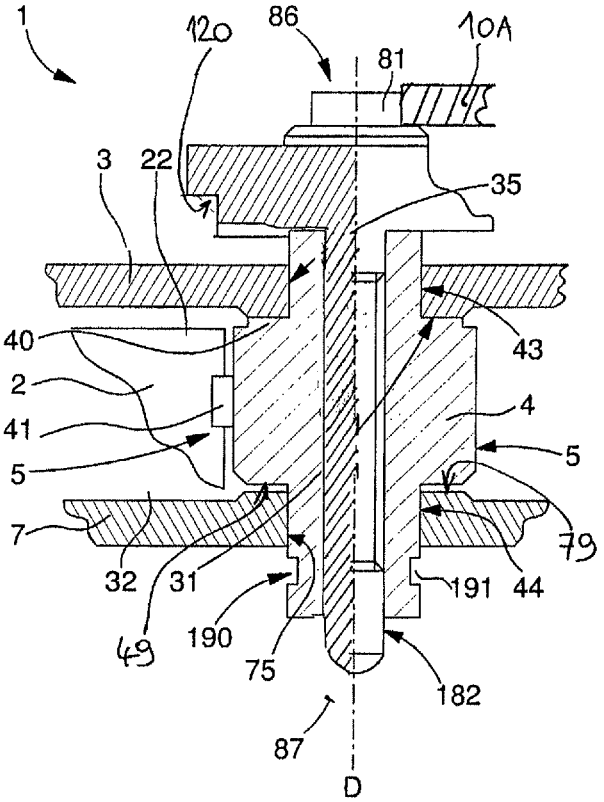
FIG. 4A is a similar embodiment with a continuous through arbour.
Figure 5A:
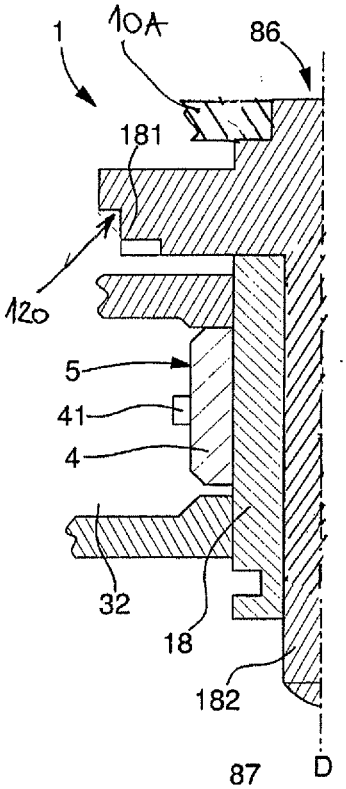
FIG. 5A is a similar embodiment with a continuous through arbour.

FIGS. 4A and 5A illustrate an embodiment in two parts with a through arbour.

Preferably, spring 2 is confined within a chamber 32, delimited by drum 3 and a cover 7 fixed to drum 3, and core 4 includes a second, outer, bottom, shafted part 44 on which a second bore 75 of cover 7 slides.

Figure 6:
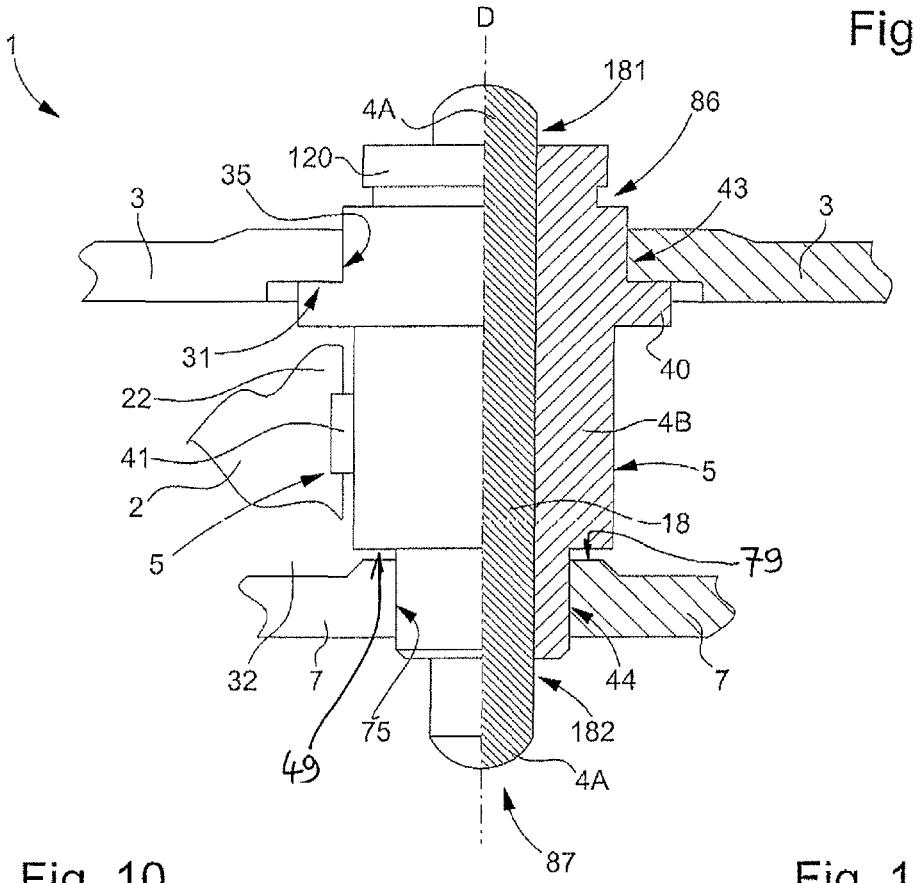
FIG. 6 is a variant of the barrel of the invention, with a core made in two coaxial parts, including one cylindrical part along the pivot axis of the barrel, and an external part carrying a collar and a hook for hooking the mainspring.

In a variant illustrated in FIG. 6, there is a smooth arbour, carrying a core with a collar, between the drum and cover. The collar forms a stop surface with an inner surface of the drum. Core 4 is thus formed in at least two parts, a first part 4A of smaller diameter than the smaller of the two diameters of first bore 35 of drum 3 and second bore 75 of cover 7, and the other second part 4B, which may be substantially tubular, including a third bore driven onto first part 4A. This second part 4B either includes receiving surface 5 for mainspring 2, or forms the inner end of mainspring 2.

In the variant illustrated in FIG. 3, the arbour is in two parts: an upper part, with guiding in the single-piece bridge and ratchet, screwed into a lower part substantially limited to the volume of the spring chamber.

Core 4 is thus made in at least two parts; preferably one of these two parts is entirely within chamber 32. A first inner part 4A includes the means 120 for fixing a ratchet 12 or forms ratchet 12 and includes the first pivot shoulder 181 in bridge 10A, 10 or in a bridge jewel 10A. This first part 4A includes a centring shoulder 183 and a first external thread 185, respectively a first internal thread, along pivot axis D.

The other second part 4B, which may be substantially tubular, includes a centring bore 184 fitted onto centring shoulder 183 and includes a second internal thread 186, respectively a second external thread, complementary to first external thread 185, respectively first internal thread of first part 4A. This second part 4B carries second shoulder 43, collar 40, and receiving surface 5 for mainspring 2 or forms the inner end of mainspring 2 and also carries shoulder 44 and fourth pivot shoulder 182.

In another variant, core 4 is made in at least two parts, a first part 4A including a cylindrical or tubular barrel arbour 18 and including at the two opposite axial ends thereof the first pivot shoulder 181 and the fourth pivot shoulder 182, which are either in a single-piece with the barrel arbour or secured thereto by screwing and/or hooping and/or welding. The other second part 4B carries second shoulder 43 and collar 40, includes receiving surface 5 for mainspring 2 or forms the inner end of mainspring 2, and also carries shoulder 44. Second part 4B includes a fifth bore driven onto first part 4A.

Advantageously, first part 4A is made in a single-piece with a ratchet-holder 81 or with a ratchet 12.

Figure 7:
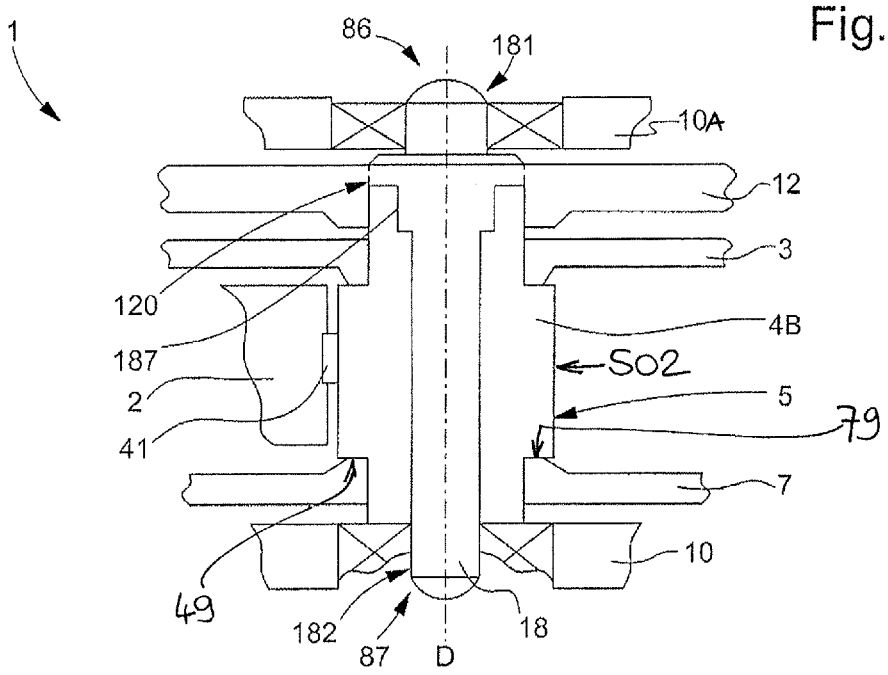
FIGS. 7 to 9 illustrate a variant of the barrel of the invention, with a means of pivotally driving a part carrying a ratchet.
Figure 8:
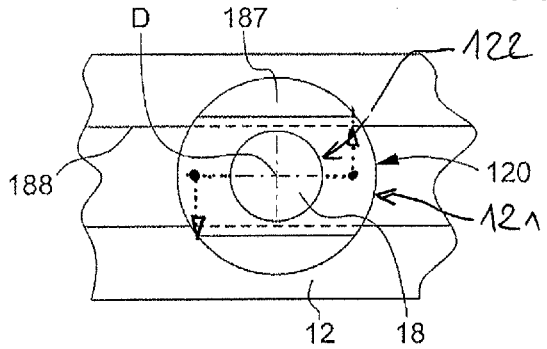
Figure 9:
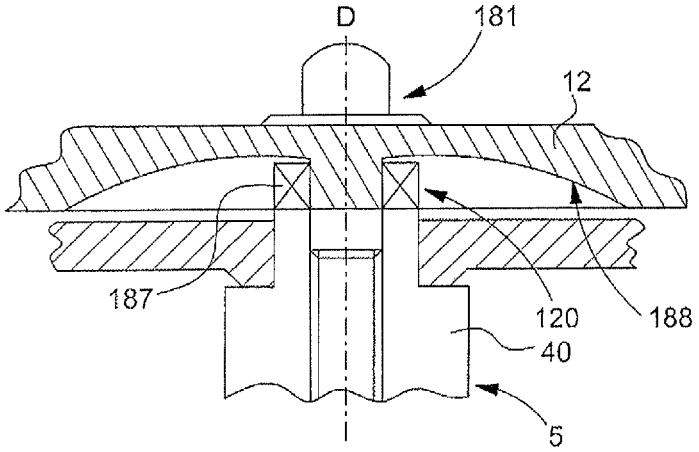

As seen in FIGS. 7 to 9, the upper end of the arbour includes drive flat parts for corresponding grooves of the ratchet, which are located in the lower part of the ratchet on the drum side.

Thus, second part 4B advantageously includes a pivotal drive means 187 for first part 4A and/or a ratchet 12 arranged to cooperate with a complementary drive means 188 comprised in first part 4A or ratchet 12, and to ensure both a pivoting contact and a contact in the axial direction of pivot axis D. In the case of the Figures, a recess 188 made in ratchet 12 by a mill tool train cooperates with a profile 187 including two milled flat parts at the end of the core.

This embodiment of FIGS. 7 to 9 is particularly well suited to very small calibres, such as the "615 BLANCPAIN" particularly for a ladies' watch. Indeed, as a result of the invention, it is possible to reduce diameter 502 to 1.00 mm. Diameter 121 of FIG. 8 has a value of 0.60 mm and diameter 122 has a value of only 0.35 mm. It is possible to pass a torque of 2 nN.m, on a radius of around 0.25 mm, as shown in dotted lines in FIG. 8, which represents a force of 4N on each vertical contact.

The application of an arbour made according to the FIG. 1 variant to the same calibre enables a saving in diameter of at least 0.10 mm relative to the existing diameter, without changing the materials of the spring or or the components; by way of example, the diameter 401 of FIG. 1 may be reduced to 0.80 mm, the diameter of shoulder 44 to 0.5 mm and the diameter of shoulder 182 to 0.30 mm.

Figure 10:
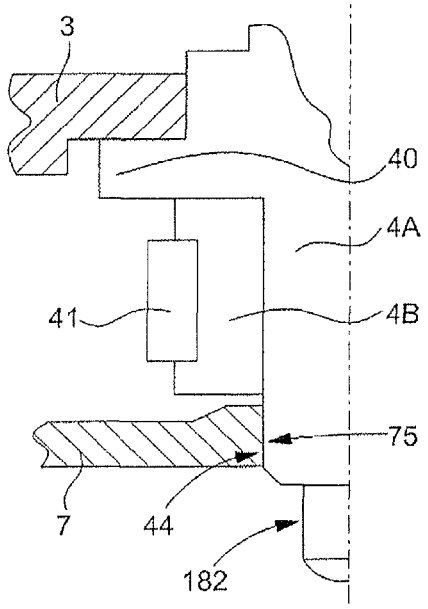
FIG. 10 shows a variant of the barrel of the invention, with a main core part carrying a collar, and an external ring carrying a hook for hooking the mainspring.
Figure 11:
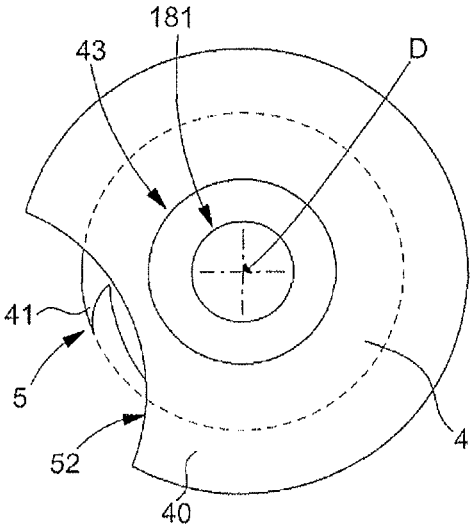
FIG. 11 shows a top view of a single-piece core with a collar and hook and whose collar includes a hollow recess for the hook machining tools.

In FIGS. 10 and 11 the arbour carries a collar between the drum and cover. The collar forms a stop surface with an inner surface of the drum as in FIG. 6. The collar has a cutout for machining the hook hooking the spring over an area of smaller diameter than that of the collar, which belongs either to the actual arbour if it is in a single-piece, or to a ring added to said arbour as is the case in the Figures.

In the advantageous, in terms of machining costs, FIG. 10 embodiment, second part 4B is made of several coaxial parts, one of which is made in the form of a ring and carries a hook 41 for hooking the eye of the at least one spring 2.

As seen in FIG. 11, in a single-piece embodiment, receiving surface 5 carries a hook 41 for hooking an eye of the at least one spring 2, and core 4 includes, to the right of hook 41, and particularly on a collar 40, a recess 52 for the passage of a mill or of straddle cutters for machining hook 41.

In a variant of the invention, ratchet 12 is in a single piece with core 4.

In a variant of the invention, receiving surface 5 is a surface of revolution relative to pivot axis D.

In a variant of the invention, spring 2 is fixed by friction to core 4.

In an advantageous embodiment of the invention, spring 2 forms, with core 4, a single-piece, welded or soldered or similar spring-core sub-assembly.

The invention also concerns a timepiece movement 100 including at least one barrel assembly 1 of this type for storing energy with one input formed either by a ratchet 12 mounted for integral rotation with core 4 or with a barrel arbour 18 integral with core 4, or by a drum toothing 13 mounted for integral rotation with drum 3, and an output respectively formed either by a drum toothing 13 mounted for integral rotation with drum 3, or by a ratchet 12 mounted for integral rotation with core 4 or with barrel arbour 18.

The invention also concerns a timepiece movement 1000 including at least one timepiece movement 100 and/or at least one barrel assembly 1 of this type for storing energy with one input formed either by a ratchet 12 mounted for integral rotation with core 4 or with a barrel arbour 18 integral with core 4, or by a drum toothing 13 mounted for integral rotation with drum 3, and an output respectively formed either by a drum toothing 13 mounted for integral rotation with drum 3, or by a ratchet 12 mounted for integral rotation with core 4 or with barrel arbour 18.

The invention claimed is:

1. A timepiece barrel assembly, comprising:

at least one barrel mainspring mounted between, at a first end a barrel drum, and at a second end, a receiving surface comprised in a barrel core coaxial to said drum about a pivot axis, wherein said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, and having a width to thickness ratio of between 9 and 21, and wherein said core is made of steel or stainless steel, and wherein the maximum radius of said core relative to said pivot axis is less than ten times the maximum thickness of said spring, and further wherein said core includes in series, from a first end towards a second end:

means of fixing a ratchet, or respectively a first pivot shoulder in a plate or a bridge of a timepiece mechanism, then a first pivot shoulder in a plate or a bridge of a timepiece mechanism, or respectively a means of fixing a ratchet, then a second pivot shoulder relative to a first bore of said drum, then a collar radially projecting relative to said second pivot shoulder and cooperating in abutment with a first inner face of said drum on the side of said at least one spring, then, with diameters relative to the pivoting axis of the barrel arbor which are decreasing relative to each other:

said receiving surface for said at least one spring, flush with or set back radially relative to said collar, then, set back radially relative to said receiving surface, a third pivot shoulder relative to a second bore in a cover arranged to form, with said drum, a chamber containing said at least one mainspring, then a fourth pivot shoulder in a plate or a bridge of said timepiece mechanism, and wherein the external diameter of said core decreases in steps from said collar towards said second end, and decreases in steps from said collar towards said first end.

2. The barrel assembly according to the claim 1, wherein said core includes between the first end and the second pivot shoulder:

the means of fixing a ratchet, and then the first pivot shoulder.

3. The barrel assembly according to claim 2, wherein said core includes between the first end and the second pivot shoulder:

the first pivot shoulder, and then the means of fixing a ratchet.

4. A timepiece movement including at least one barrel assembly according to claim 1 for storing energy with one input formed either by a ratchet mounted for integral rotation with said core or with a barrel arbour integral with said core, or by a drum toothing mounted for integral rotation with said drum, and an output respectively formed either by a drum toothing mounted for integral rotation with said drum, or by a ratchet mounted for integral rotation with said core or with said barrel arbour.

5. A timepiece including at least one barrel assembly according to claim 1 for storing energy with one input formed either by a ratchet mounted for integral rotation with said core or with a barrel arbour integral with said core, or by a drum toothing mounted for integral rotation with said drum, and an output respectively formed either by a drum toothing mounted for integral rotation with said drum, or by a ratchet mounted for integral rotation with said core or with said barrel arbour.

6. A timepiece barrel assembly, comprising:

at least one barrel mainspring mounted between, at a first end a barrel drum, and at a second end, a receiving surface comprised in a barrel core coaxial to said drum about a pivot axis, wherein said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, and having a width to thickness ratio of between 9 and 21, and wherein said core is made of steel or stainless steel, and wherein the maximum radius of said core relative to said pivot axis is less than ten times the maximum thickness of said spring, and further wherein said core includes in series, from a first end towards a second end:

means of fixing a ratchet, or respectively a first pivot shoulder in a plate or a bridge of a timepiece mechanism, then a first pivot shoulder in a plate or a bridge of a timepiece mechanism, or respectively a means of fixing a ratchet, then a second pivot shoulder relative to a first bore of said drum, then a collar radially projecting relative to said second pivot shoulder and cooperating in abutment with a first inner face of said drum on the side of said at least one spring, then, with diameters relative to the pivoting axis of the barrel arbor which are decreasing relative to each other:

said receiving surface for said at least one spring, flush with or set back radially relative to said collar, then, set back radially relative to said receiving surface, a third pivot shoulder relative to a second bore in a cover arranged to form, with said drum, a chamber containing said at least one mainspring, then a fourth pivot shoulder in a plate or a bridge of said timepiece mechanism, wherein said core is made in two parts, a first part, of smaller diameter than the smallest of the two diameters of said first bore of said drum and of said second bore of the cover, and the other second part including a third bore driven onto said first part and said second part either includes said receiving surface for said mainspring or forms the inner end of said mainspring.

7. The barrel assembly according to claim 6, wherein said second part is made of several coaxial parts, one of which is made in the form of a ring and carries a hook for hooking an eye of said at least one spring.

8. The barrel assembly according to claim 6, wherein said ratchet is in a single-piece with said core.

9. A timepiece barrel assembly, comprising:

at least one barrel mainspring mounted between, at a first end a barrel drum, and at a second end, a receiving surface comprised in a barrel core coaxial to said drum about a pivot axis, wherein said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, and having a width to thickness ratio of between 9 and 21, and wherein said core is made of steel or stainless steel, and wherein the maximum radius of said core relative to said pivot axis is less than ten times the maximum thickness of said spring, and further wherein said core includes in series, from a first end towards a second end:

means of fixing a ratchet, or respectively a first pivot shoulder in a plate or a bridge of a timepiece mechanism, then a first pivot shoulder in a plate or a bridge of a timepiece mechanism, or respectively a means of fixing a ratchet, then a second pivot shoulder relative to a first bore of said drum, then a collar radially projecting relative to said second pivot shoulder and cooperating in abutment with a first inner face of said drum on the side of said at least one spring, then, with diameters relative to the pivoting axis of the barrel arbor which are decreasing relative to each other:

said receiving surface for said at least one spring, flush with or set back radially relative to said collar, then, set back radially relative to said receiving surface, a third pivot shoulder relative to a second bore in a cover arranged to form, with said drum, a chamber containing said at least one mainspring, then a fourth pivot shoulder in a plate or a bridge of said timepiece mechanism, wherein said core is made in two parts, a first part called the inner part including said means of securing a ratchet or forming said ratchet, and including said first pivot shoulder, said first part including a centring shoulder and a first external thread, respectively a first internal thread, along said pivot axis, and the other second part including a fourth centring bore fitted onto said centring shoulder, and including a second internal thread, respectively a second external thread complementary to said first external thread, respectively first internal thread, of said first part, said second part carrying said second pivot shoulder relative to the first bore of said drum, said collar, and said receiving surface for said mainspring or forming the inner end of said mainspring, and also carrying said third pivot shoulder relative to the second bore of said cover and said fourth pivot shoulder.

10. A timepiece barrel assembly, comprising:

at least one barrel mainspring mounted between, at a first end a barrel drum, and at a second end, a receiving surface comprised in a barrel core coaxial to said drum about a pivot axis, wherein said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, and having a width to thickness ratio of between 9 and 21, and wherein said core is made of steel or stainless steel, and wherein the maximum radius of said core relative to said pivot axis is less than ten times the maximum thickness of said spring, and further wherein said core includes in series, from a first end towards a second end:

means of fixing a ratchet, or respectively a first pivot shoulder in a plate or a bridge of a timepiece mechanism, then a first pivot shoulder in a plate or a bridge of a timepiece mechanism, or respectively a means of fixing a ratchet, then a second pivot shoulder relative to a first bore of said drum, then a collar radially projecting relative to said second pivot shoulder and cooperating in abutment with a first inner face of said drum on the side of said at least one spring, then, with diameters relative to the pivoting axis of the barrel arbor which are decreasing relative to each other:

said receiving surface for said at least one spring, flush with or set back radially relative to said collar, then, set back radially relative to said receiving surface, a third pivot shoulder relative to a second bore in a cover arranged to form, with said drum, a chamber containing said at least one mainspring, then a fourth pivot shoulder in a plate or a bridge of said timepiece mechanism, wherein said core is made in two parts, a first part including a cylindrical or tubular barrel arbour and including at the two opposite axial ends thereof said first pivot shoulder and said fourth pivot shoulder, which are either in a single-piece with the barrel arbour or secured thereto by screwing and/or hooping and/or welding, and the other second part which carries said second pivot shoulder relative to the first bore of said drum and said collar, includes said receiving surface for said mainspring or forms the inner end of said mainspring, and also carries said third pivot shoulder relative to the second bore of said cover, said second part including a fifth bore driven onto said first part.

11. The barrel assembly according to the claim 10, wherein said first part is in a single piece with a ratchet-holder or with said ratchet.

12. The barrel assembly according to claim 10, wherein said second part includes a pivotal drive means for said first part and/or a said ratchet arranged to cooperate with a complementary drive means of said first part or of said ratchet, and to ensure both a pivoting contact and a contact in the axial direction of said pivot axis.

* * * * *